US011019909B2

(12) United States Patent
Wojcik et al.

(10) Patent No.: US 11,019,909 B2
(45) Date of Patent: Jun. 1, 2021

(54) LIP/SKIN APPLICATOR DEVICE WITH ROTATABLE FEATURE

(71) Applicant: BLISTEX INC., Oak Brook, IL (US)

(72) Inventors: Michael Wojcik, Lemont, IL (US); Kelly Sanborn, Naperville, IL (US)

(73) Assignee: BLISTEX INC., Oak Brook, IL (US)

( * ) Notice: Subject to any disclaimer, the term of this patent is extended or adjusted under 35 U.S.C. 154(b) by 244 days.

(21) Appl. No.: 15/565,021

(22) PCT Filed: Apr. 7, 2016

(86) PCT No.: PCT/US2016/026350
§ 371 (c)(1),
(2) Date: Oct. 6, 2017

(87) PCT Pub. No.: WO2016/164527
PCT Pub. Date: Oct. 13, 2016

(65) Prior Publication Data

US 2018/0310690 A1 Nov. 1, 2018

Related U.S. Application Data

(63) Continuation-in-part of application No. 14/681,636, filed on Apr. 8, 2015, now abandoned.

(51) Int. Cl.

| | |
|---|---|
| ***A45D 40/26*** | (2006.01) |
| ***A45D 40/00*** | (2006.01) |
| ***A45D 40/22*** | (2006.01) |

(52) U.S. Cl.
CPC ..... *A45D 40/0068* (2013.01); *A45D 40/222* (2013.01); *A45D 40/26* (2013.01); *A45D 2040/224* (2013.01); *A45D 2040/225* (2013.01)

(58) Field of Classification Search
CPC ..... A45D 40/00; A45D 40/22; A45D 40/26; A45D 40/225; A45D 40/0068; A45D 40/221; A45D 40/223
USPC ..... 220/4.25, 4.21, 4.24, 288
See application file for complete search history.

(56) References Cited

U.S. PATENT DOCUMENTS

| | | | | |
|---|---|---|---|---|
| 1,852,455 A * | 4/1932 | Friedman | A45D 33/00 132/293 |
| 6,102,209 A * | 8/2000 | D'Andrea | A45D 40/0068 206/581 |
| 2014/0086661 A1* | 3/2014 | Adams | A45D 40/065 401/68 |
| 2015/0037082 A1* | 2/2015 | Pires | A45D 40/00 401/88 |

* cited by examiner

*Primary Examiner* — Rachel R Steitz

(57) ABSTRACT

A lip or skin applicator device includes a first housing portion (20) and a second housing portion (60) rotatably connected to the first housing portion. The second housing portion rotates about the first housing portion such that, in the closed position, the product is enclosed within the first housing portion and the second housing portion, and in the open position, the product (90) is exposed and the first housing portion is at least partially housed within the second housing portion. The lip or skin applicator device may include an opening with a plurality of fins (24) into which a portion of a product is inserted.

10 Claims, 9 Drawing Sheets

SECTION A-A

LIP/SKIN APPLICATOR DEVICE WITH ROTATABLE FEATURE

FIELD OF THE INVENTION

The present invention relates to an applicator device for dispensing a product. More particularly, the present invention relates to lip or skin applicator devices and associated methods of using the devices that are especially adapted to apply a product onto the epidermis of humans.

BACKGROUND

Skin care has long been recognized as an important factor in our overall health and well-being. This is particularly true for lips, whose exposed mucous membrane structure is different than other skin. Lips do not have the same protective outer layer, or stratum corneum, found in other skin; nor do lips have the same complement of oil and sweat glands. Sweat glands add moisture to skin, but the lips' only source of moisture is saliva inside the mouth. Thus, harsh winter wind, cold, sun and dryness—indoors and outdoors—make lips a vulnerable target for chapping.

Skin or lip care products are often applied as preventative care. For example, lip balm is often applied to prevent chapped lips. When applied prior to harsh winter wind, cold, sun and dryness, lip balm has proven effective in providing protection to a person's lips. Lip balm may also be used after a person's lips become chapped to soothe the person's lips and prevent further damage from occurring.

Skin or lip care products are typically packaged in containers that are opened and closed by removing a cap or other housing. These caps are often dropped. A dropped cap can become contaminated, which can in turn cause contamination of the product applied to the skin. The caps are also often lost, leaving the user with an exposed product that can become contaminated in any number of ways. In addition to contamination, the exposed product could become damaged and could also damage or soil other objects with which it comes into contact, particularly in an enclosed environment (such as a handbag). Further, if the skin or lip care product is left uncovered, key ingredients in the product can degrade from exposure to the air and lose their efficacy.

Skin or lip care products are typically mounted to a portion of the package in which they are housed. The products often become loose or break during application of the product. This leads to frustration on the part of the user.

BRIEF SUMMARY OF THE INVENTION

In one aspect of the invention, an applicator device includes a first housing portion to which a product is attached and a second housing portion rotatably connected to the first housing portion to allow the second housing portion to rotate about the first housing portion between a closed position and an open position. The second housing portion rotates about the first housing portion such that, in the closed position, the product is enclosed within the first housing portion and the second housing portion, and in the open position, the product is exposed and the first housing portion is at least partially housed within the second housing portion.

In another aspect of the invention, an applicator device includes a first housing portion to which a product is attached and a second housing portion connected to the first housing portion. The first housing portion includes an opening into which a portion of the product is inserted. The opening includes a plurality of fins extending radially towards a center of the opening and protruding into the product.

In another aspect of the invention, a method of using an applicator device includes obtaining an applicator device that includes a first housing portion; a product attached to the first housing portion, and a second housing portion connected to the first housing portion. The method includes rotating the second housing portion about the first housing portion from a closed position to an open position, and pressing the product of the applicator device onto one or both lips of a user to apply the product. When pressing the product onto one or both lips the user may press the product onto both lips simultaneously.

Numerous other features and advantages of the present invention will be readily apparent to those of ordinary skill in the art upon reading of the following detailed description of presently preferred, but nonetheless illustrative, embodiments of the present invention when taken in conjunction with the accompany drawings. In this respect, before explaining embodiments of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

Before undertaking the detailed description of the invention below, it may be advantageous to set forth definitions of certain words and phrases used throughout this patent document. Throughout this specification, unless the context requires otherwise, the word "comprise" or variations such as "comprises" or "comprising" or the term "includes" or variations, thereof, or the term "having" or variations, thereof will be understood to imply the inclusion of a stated element or integer or group of elements or integers but not the exclusion of any other element or integer or group of elements or integers. Furthermore, a person skilled in the art of reading claimed inventions should understand that "a" and "an" each generally denotes "at least one," but does not exclude a plurality unless the contextual use dictates otherwise. And that the term "or" denotes "at least one of the items," but does not exclude a plurality of items of the list.

In the following description of the invention, certain terminology is used for the purpose of reference only, and is not intend to be limiting. Terms such as "upper", "lower", "above", and "below," refer to directions in the drawings to which reference is made. Terms such as "inwards" and "outward" refer to directions towards and away from, respectively, the geometric center of the component described. Terms such as "side", "top", "bottom," "horizontal," and "vertical," describe the orientation of portions of the component within a consistent but arbitrary frame of reference which is made clear by reference to the text and the associated drawings describing the component under discussion. Such terminology includes words specifically mentioned above, derivatives thereof, and words of similar import.

Those skilled in the art will appreciate that the invention described herein is susceptible to variations and modifications other than those specifically described. It is to be understood that the invention includes all such variations and modification which fall within its spirit and scope.

BRIEF DESCRIPTION OF THE FIGURES (NON-LIMITING EMBODIMENTS OF THE DISCLOSURE)

The invention will be better understood and aspects other than those set forth above will become apparent when consideration is given to the following description thereof. Such description makes reference to the annexed drawings, wherein:

FIG. 1A is a cross-sectional view showing an embodiment of the applicator device constructed in accordance with the principles of the present invention. FIGS. 1B-1D are trimetric perspective views showing the embodiment in closed, partially open and fully open positions.

FIGS. 2A and 2B are a trimetric perspective view and a top view, respectively, showing an embodiment of the first housing portion of the applicator device constructed in accordance with the principles of the present invention. FIG. 2C is a front perspective view showing an embodiment of the first housing portion of the applicator device constructed in accordance with the principles of the present invention. FIG. 2D is a cross-sectional view taken along line B-B of FIG. 2C. FIG. 2E is a side perspective view showing an embodiment of the first housing portion of the applicator device constructed in accordance with the principles of the present invention. FIG. 2F is a cross-sectional view taken along line E-E of FIG. 2E.

FIGS. 3A and 3B are a top view and a trimetric perspective view, respectively, showing an embodiment of the cover which attaches to the first housing portion of the applicator device constructed in accordance with the principles of the present invention. FIG. 3C is a front perspective view showing an embodiment of the cover which attaches to the first housing portion of the applicator device constructed in accordance with the principles of the present invention. FIG. 3D is a cross-sectional view taken along line F-F of FIG. 3C. FIG. 3E is a side perspective view showing an embodiment of the cover which attaches to the first housing portion of the applicator device constructed in accordance with the principles of the present invention. FIG. 3F is a cross-sectional view taken along line G-G of FIG. 3E.

FIGS. 4A and 4B are a trimetric perspective view and a top view, respectively, showing an embodiment of the second housing portion of the applicator device constructed in accordance with the principles of the present invention. FIG. 4C is a side perspective view showing an embodiment of the second housing portion of the applicator device constructed in accordance with the principles of the present invention. FIG. 4D is a cross-sectional view taken along line F-F in FIG. 4C. FIG. 4E is a front perspective view showing an embodiment of the second housing portion of the applicator device constructed in accordance with the principles of the present invention. FIG. 4F is a cross-sectional view taken along line G-G of FIG. 4E.

DETAILED DESCRIPTION

Figure 1A:
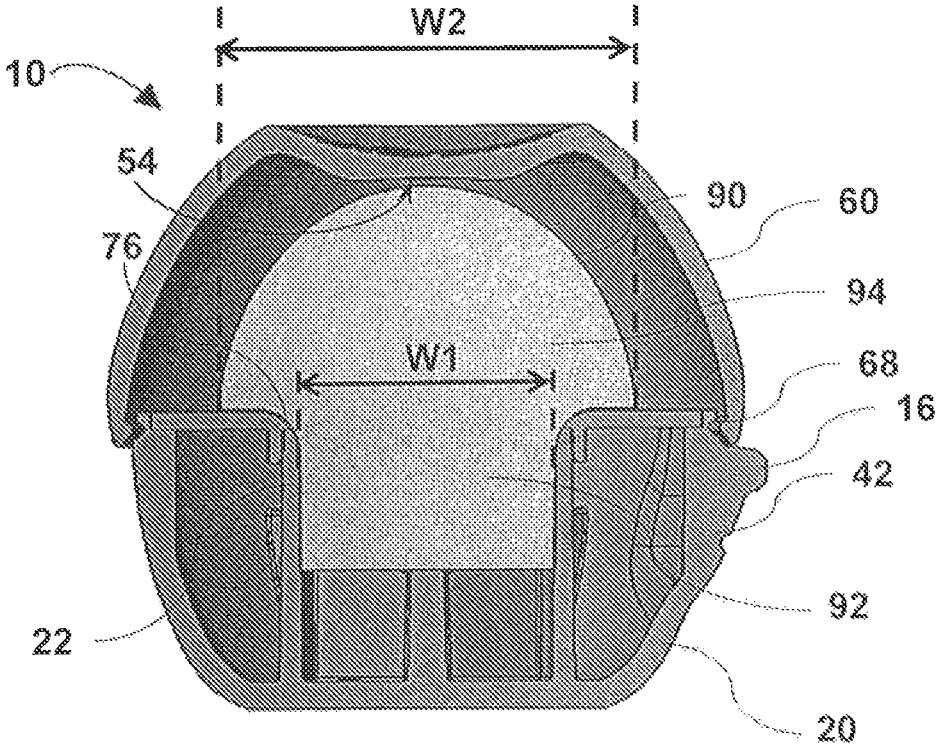

Referring now to FIGS. 1A-1D, an embodiment of the applicator device 10 is shown and generally designated by the reference numeral 10. The applicator device 10 has a lower (or first) housing portion 20 and an upper (or second) housing portion 60. The housing portions are referred to as an upper portion and a lower portion for convenience only, and whether or not these portions are on the top or bottom will depend on how the user positions the device. A product 90, which may, for example, be a lip balm, is attached to the first housing portion 20, and the first and second housing portions 20 and 60 are rotatably/pivotally connected.

Figure 1B:
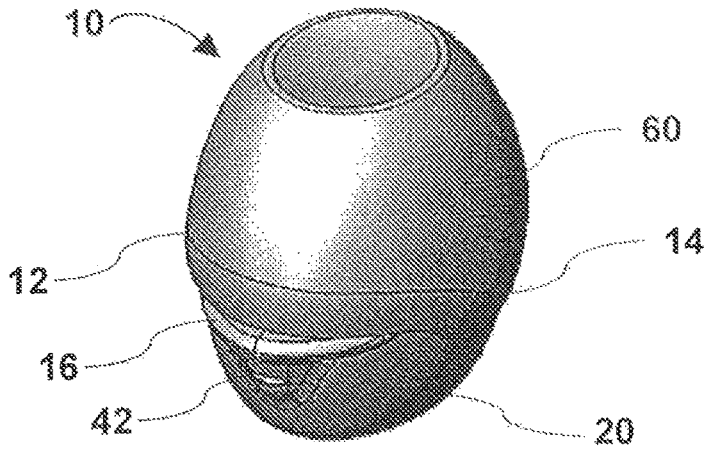
Figure 1C:
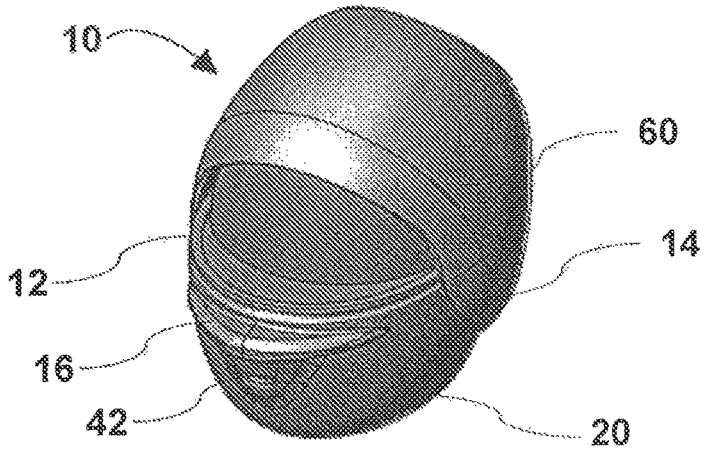
Figure 1D:
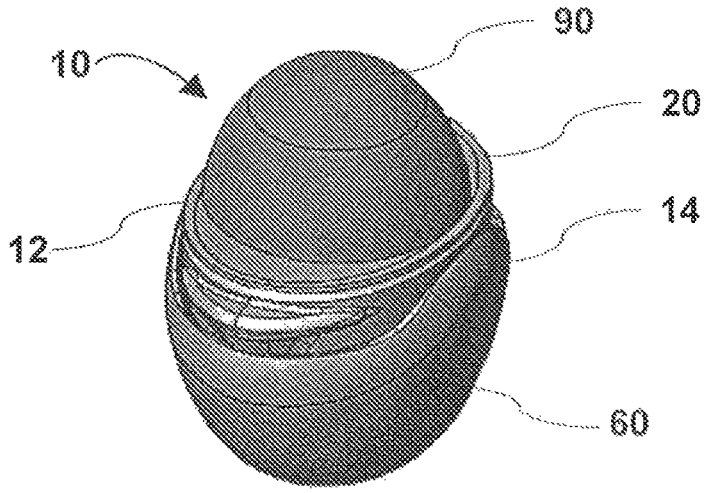

The rotatable/pivotal connection of the first and second housing portions 20 and 60 allows the second housing portion 60 to rotate about the first housing portion 20 between an open position and a closed position, as shown, for example, in FIGS. 1B-1D. When the first and second housing portions 20 and 60 are in the closed position (FIG. 1B), the product 90 is enclosed within the applicator device 10 (i.e., within the top and bottom housing portions 60 and 20). When the first and second housing portions 20 and 60 are in the open position (FIG. 1D), the product 90 is exposed allowing a user of the applicator device 10 to apply the product 90 to their skin. In the open position, the second housing portion 60 is rotated about the first housing portion 20 so that the second housing portion 60 covers or houses at least a portion of the first housing portion 20. Accordingly, the applicator device is a convenient, easy-to-use device that remains as a single connected entity regardless of whether it is in the open or closed position.

The rotating motion of the second housing portion 60 may be accomplished by first and second pivot joints 12 and 14. In the embodiment shown in FIGS. 1A-1D, the first and second pivot joints 12 and 14 are formed on diametrically opposing portions of the first and second housing portions 20 and 60. The applicator device 10 may also include a lever 16 for helping to open or close the applicator device, and an open position snap bead detent 42 for holding the device in the open position.

Typically, when a user desires to use a lip or skin applicator the user must completely remove the cap from the applicator before applying the product. This configuration is problematic, as the cap may be dropped, contaminated or even lost when removed. The pivotal or rotatable connection of the first and second housing portions 20 and 60 of the applicator device 10 prevents these problems. The applicator device 10 can be opened by rotating the second housing portion 60, and thus one does not need to be concerned with dropping, contaminating or losing a part of the applicator device 10 during application of a product 90. Further, since the first and second housing portions 20 and 60 can be maintained as a single connected entity regardless of whether the applicator device 10 is opened or closed, a user always has access to the means by which the device 10 is closed, making it easier to keep the product 90 closed when it is not being used, thereby preventing damage to the product and also preventing key ingredients of the product 90 from degrading and losing their efficacy.

Figure 2A:
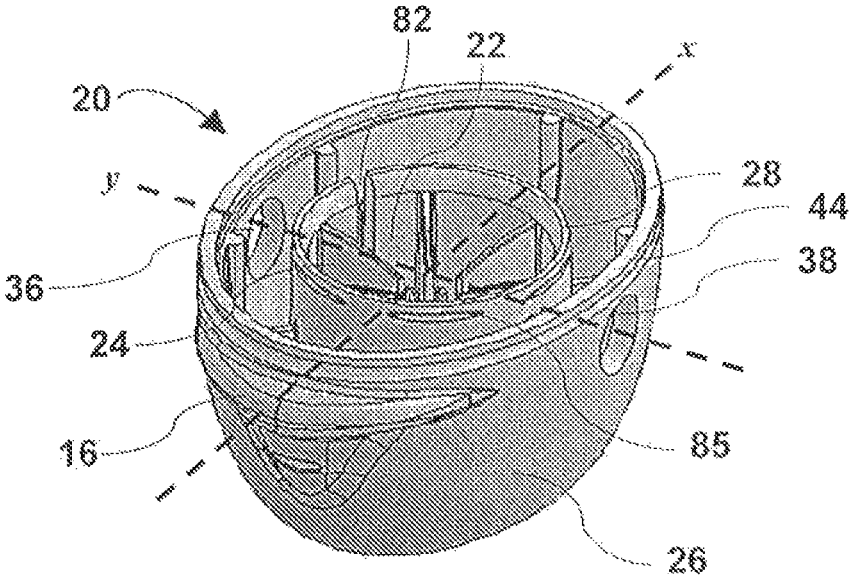
Figure 2B:
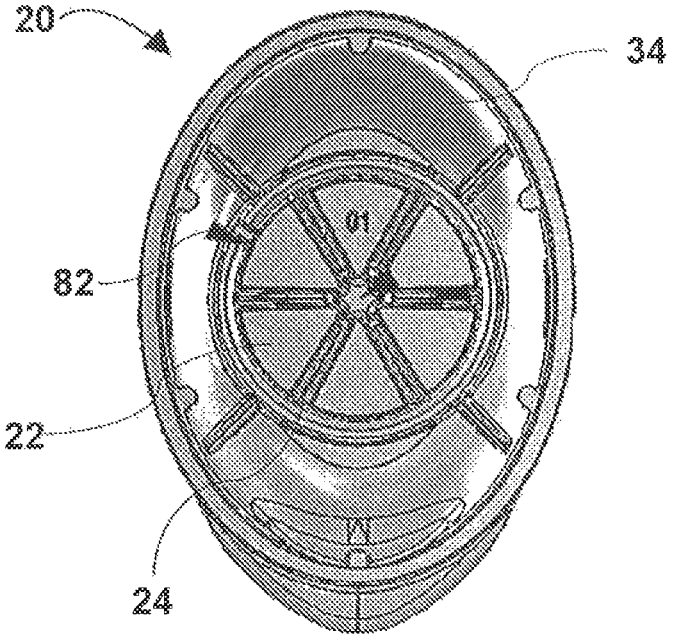
Figure 2C:
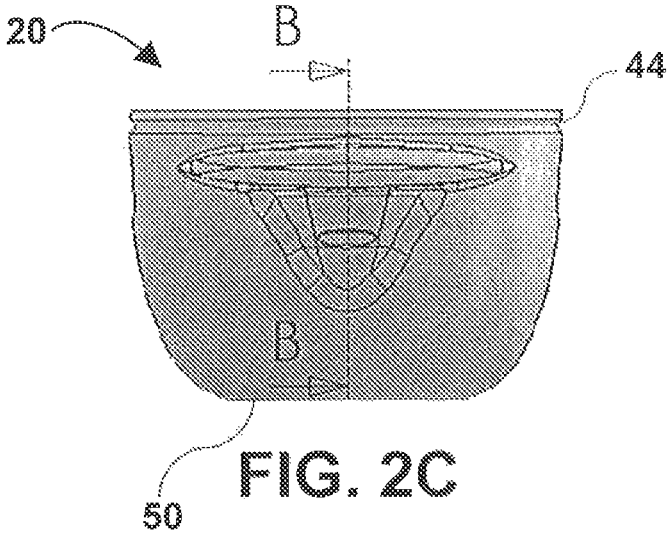
Figure 2D:
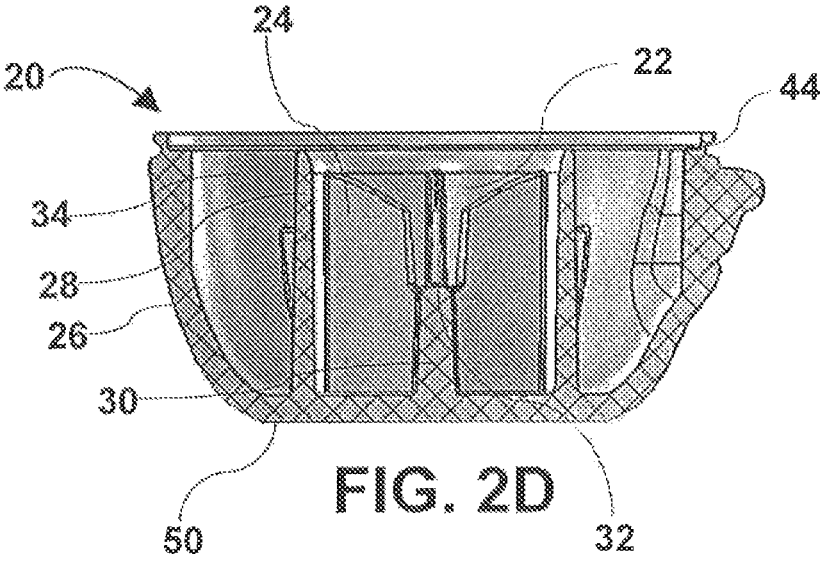
Figure 2E:
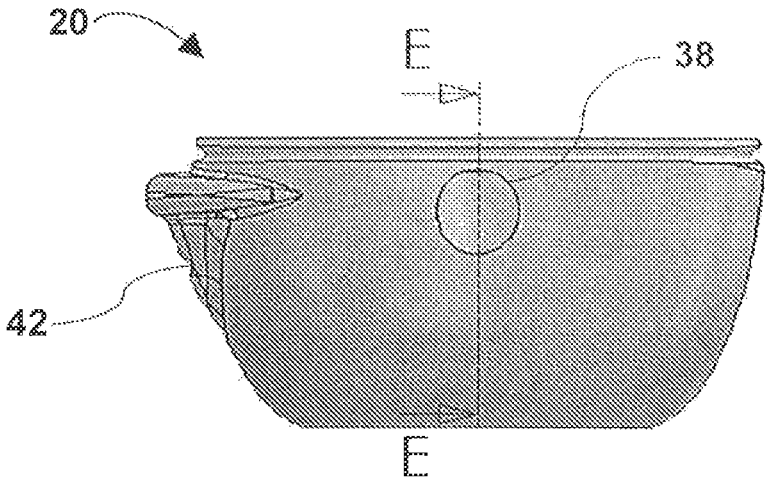
Figure 2F:
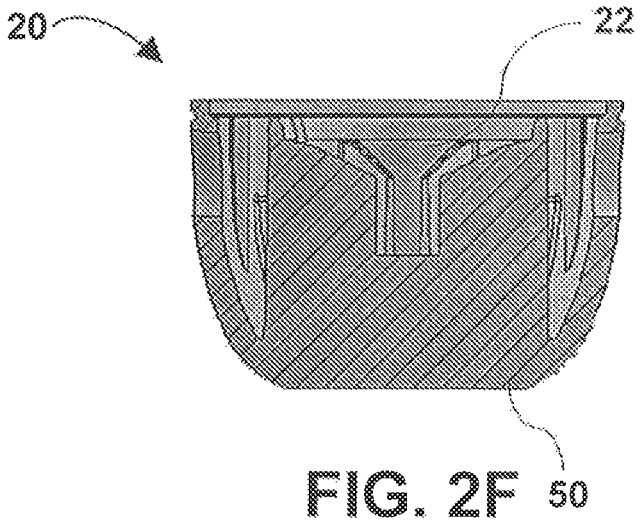

Turning now to FIGS. 2A-2F, which show the first housing portion 20 of an applicator device 10 according to an embodiment of the present invention. FIGS. 2A and 2B are perspective and top views, respectively. FIG. 2C is a front perspective view. FIG. 2D is a cross-sectional view taken along line B-B in FIG. 2C. FIG. 2E is a side perspective view. FIG. 2F is a cross-sectional view taken along line E-E of FIG. 2E.

In an embodiment, the outermost surface of the first housing portion 20 may have a substantially semi-ellipsoidal shape when viewed from a side and the outline of the first housing portion 20 is an oval when viewed from above. The bottom 50 of the first housing portion 20 may be cut-off or flattened allowing the applicator device 10 to be set on a table or other surface without tipping. In the embodiment shown in FIGS. 2A-2F, the bottom 50 of the first housing portion 20 is flat. In another embodiment, the bottom 50 of the first housing portion 20 may project inward from the lower-most point of the first housing portion 20.

The first housing portion 20 may, for example, be forming by an injection molding process. However, it should be understood that other processes known in the art may also be used to form the first housing portion 20. Furthermore, the first housing portion 20 may, for example, be formed of polypropylene. However, the first housing portion 20 is not limited to this material, and other plastics, thermoplastics or any other suitable material may be used in its place.

The substantially semi-ellipsoidal shape of the first housing portion 20 advantageously allows a person grip and open the applicator device 10 in a convenient manner. However, it should be understood that the first housing portion 20 is not limited to a semi-ellipsoidal shape and may take another shape, such as semi-spherical.

Referring to FIGS. 1A-2F, the first housing portion 20 provides the platform on which the product 90 is mounted and secured. An opening 22 is provided within the first housing portion 20, and a portion 92 of the product 90 is provided within this opening 22. The width W1 of the portion 92 of the product 90 inserted into the opening 22 may be equal or less than the width W2 of the portion of the product 90 that is positioned over the uppermost surface of the first housing portion 20. The portion 92 of the product 90 inserted into the opening 22 will hereinafter be referred to as the neck 92, and the remaining portion of the product is referred to as the application portion 94.

The first housing portion 20 may comprise an outer wall 26 and an inner wall 28. The outer wall 26 of the first housing portion 20 is shaped like a basin. The inner wall 28 is formed within the outer wall 26 while leaving an open space 34 between the inner wall 28 and the outer wall 26. The inner wall 28 creates the opening 22 in which the neck 92 is inserted. The outer wall 26 may have a substantially oval shape when viewed on top, and the inner wall 28 may have a substantially circular shape that surrounds the opening 22 when viewed on top. The inner wall 28 includes a plurality of fins 24 that extend radially from an inner surface of the inner wall 28 towards the center of the opening 22. The fins 24 help to secure the product 90 to the first housing portion 20 and prevent unwanted movement of the product 90 after it is mounted to the first housing portion 20. As shown, for example, in FIGS. 2*a* and 2*d*, these fins 24 are preferably comprised of a plurality of inwardly down slanting structure.

The opening 22 may include a lower part and an upper part. The fins 24 may extend from the upper part to the lower part, or may exist only in the upper part. A post 30 may be formed in the lower part of the opening. The post 30 may be formed in the center of the opening (i.e., in the radial center of the fins 24) and extend from an inner lower surface of the first housing portion 20 in a direction substantially perpendicular to the inner lower surface. The uppermost surface 32 of the of the post 30 may provide a surface on which the product 90 sits.

In the upper part of the opening 22, the fins 24 may extend to, but may not reach, the center of the opening from the inner surface of the inner wall 28. In the lower part of the opening 22, the fins 24 may extend to and be integrated with the post 30. The fins 24 may have a constant thickness, as is shown in FIGS. 2A-2D. Alternatively, the thickness of the fins 24 in the lower part of the opening 22 may be increased relative to their thicknesses in the upper part of the opening to provide additional surfaces on which the product 90 sits.

The inner wall 28 may also include an air vent 82. The air vent 82 may be an elongated slit that extends from the upper part of the inner wall 28 to the lower part. The air vent 82 may have a different shape, such as a circle, positioned at the lower part of the of the inside wall 28. The air vent 82 allows the neck 92 of the product 90 to sit in the opening 22.

The thickness of the inner wall 28 may decrease near the top of inner wall 28 in order to create a decline. This decline may be flat or curved. As illustrated in FIG. 1A, the intersection of the neck 92 and the application portion 94 of the product 90 may be curved. The declined inner upper surface 76 corresponds to the curved intersection of the neck 92 and the application portion 94.

Referring to FIGS. 1-3, in an embodiment, the first housing portion 20 may further comprise a cover 70 having an opening 72, an upper surface 76, and an attachment ring 78. The cover 70 attaches to the first housing portion 20 and hides the open space 34 from view. The cover 70 includes an opening 72 that is in communication with the opening 22 created by the inner wall 28.

Figure 3A:
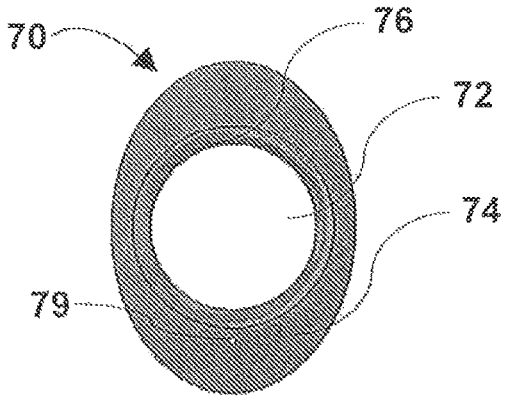
Figure 3B:
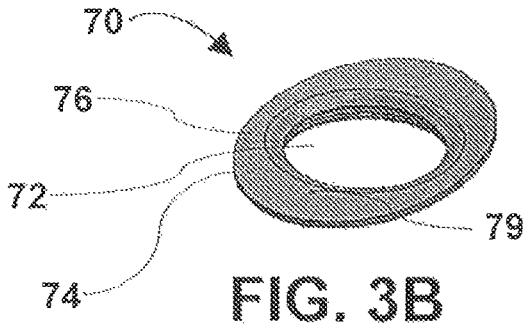
Figure 3C:
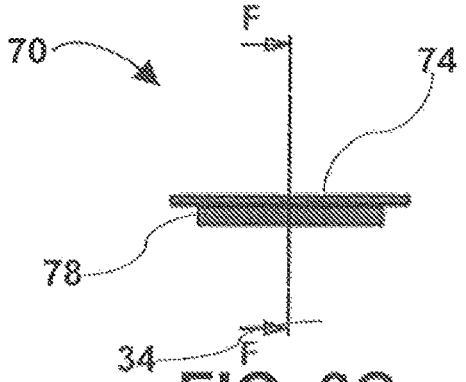
Figure 3D:
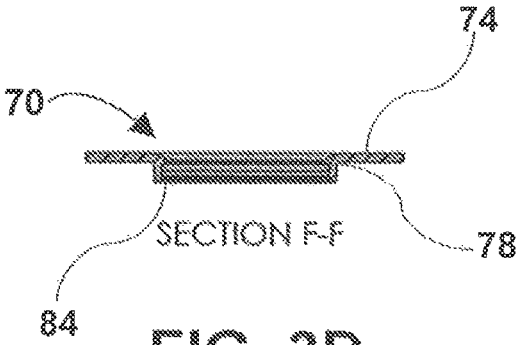
Figure 3E:
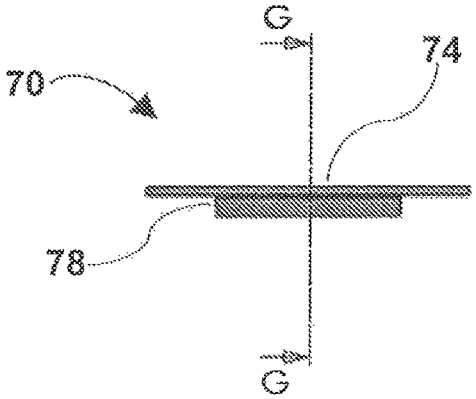
Figure 3F:
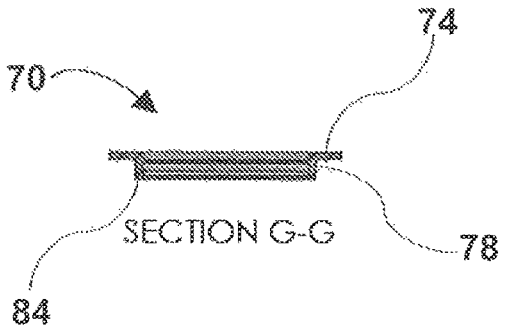

The upper surface 76 of the cover 70 may include a flat outer upper surface 74 and a declined inner upper surface 76. As illustrated in FIGS. 3D and 3F, the declined inner upper surface 76 declines from the flat outer upper surface 74 to the opening 72. This decline may be a flat or curved decline. As illustrated in FIG. 1A, the intersection of the neck 92 and the application portion 94 of the product 90 may be curved. The declined inner upper surface 76 attaches to the top of the inner wall and, together with the decline in the top of the inner wall, forms a declining surface that corresponds to the curved intersection of the neck 92 and the application portion 94.

The cover 70 may include a hole 79. The hole 79 acts as a vent and provides a path for air in the open space 34 when the cover closes the open space 34 on the top of the first housing portion 20. Thus, the small hole 79 allows the cover 70 to easily close the open space 34.

The attachment ring 78 may be circular and may have a diameter that is slightly larger than that of the inner wall 28. The attachment ring 78 may include one or more snap beads 84 formed on an inner surface of the attachment ring 78. The one or more snap beads 84 may engage with one or more snap beads 85 formed on the outer surface of the inner wall 28 (see FIG. 2A), so that the attachment ring 78 snaps onto inner wall 28 via snap beads 84 and 85 on both the attachment ring and the inner wall 28.

As illustrated in FIG. 1A, the application portion 94 of the product 90 may rest above the upper surface of the cover 70 so that a lowermost surface of the application portion 94 is not in direct contact with the upper surface of the cover 70 when the applicator device 10 is not in use. When a user presses the product to his or her lips, the lowermost surface of the application portion may contact the upper surface of the cover 70.

The basin shaped outer wall 26, the inner wall 28 and the cover 70 create a structurally sound compartment for the product 90 that is light weight and saves on material. Because of this structure, the first housing portion 20 does not have to be made of solid plastic. Instead, the inner wall 28 provides the opening 22 into which the product 90 is inserted, and the fins 24 and post 30 support the product 90 and prevent it from moving around.

Figure 5A:
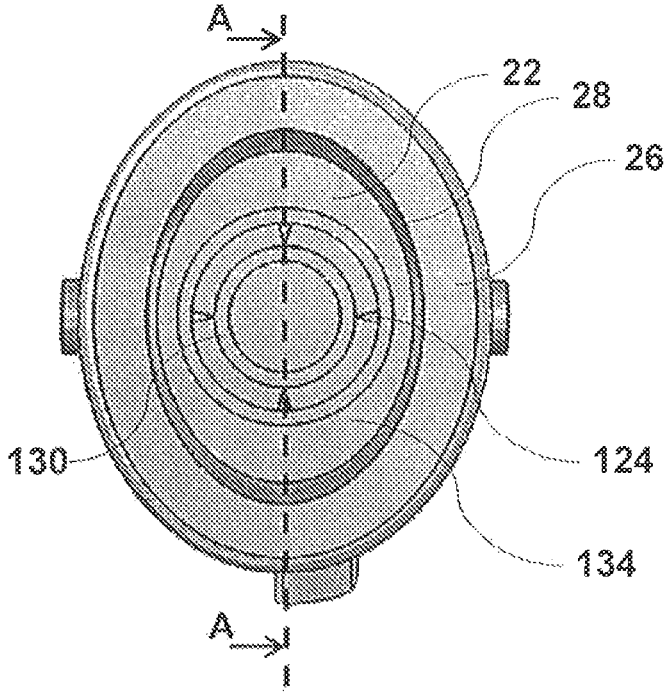
FIG. 5A is a top perspective view showing an embodiment of the first housing portion of the applicator device constructed in accordance with the principles of the present invention.
Figure 5B:
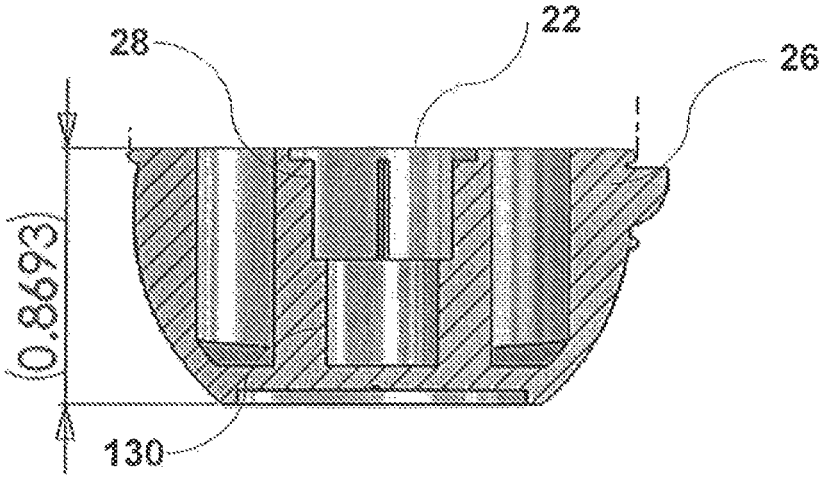
FIG. 5B is a cross-sectional view taken along line A-A of FIG. 5A.

FIGS. 5A-5B illustrate another embodiment of the product support structure of the first housing portion 20. Referring to FIGS. 5A-5B, the opening 22 may instead include a plurality of splines/elongated protrusions 124. When the neck 92 of the product 90 is inserted into the opening 22, the protrusions 124 protrude within the neck 92.

In the embodiment shown in FIGS. 5A and 5B, the outer wall 26 is relatively thick, and the inner wall 28 is formed within the outer wall 26 so as to create a groove 134 between the inner wall 28 and the outer wall 26. The splines/elongated protrusions 124 are formed on the inner surface of the inner wall 28, and the splines/elongated protrusions 124 project into the opening 22. A resting surface for the product 90 may be formed by either decreasing the width of the inner wall or forming an additional innermost wall 130 within the inner wall 28 that has a height less than the inner wall 28.

Referring again to FIG. 2, a first female socket 36 and a second female socket 38 are formed on diametrically opposing portions of the first housing portion 20. The first and second female sockets 36 and 38 are each formed within the outer surface of the outer wall 26. The first and second female sockets 36 and 38 may be formed to pass partially through the outer wall 26 or entirely through the outer wall 26.

Preferably, the first and second female sockets 36 and 38 are formed near the top of the first housing portion 20 along the short axis y (see FIG. 2A). Placing the first and second female sockets 36 and 38 along the short axis y is advantageous for opening and closing the applicator device 10 and handling the applicator device 10.

Figure 6A:
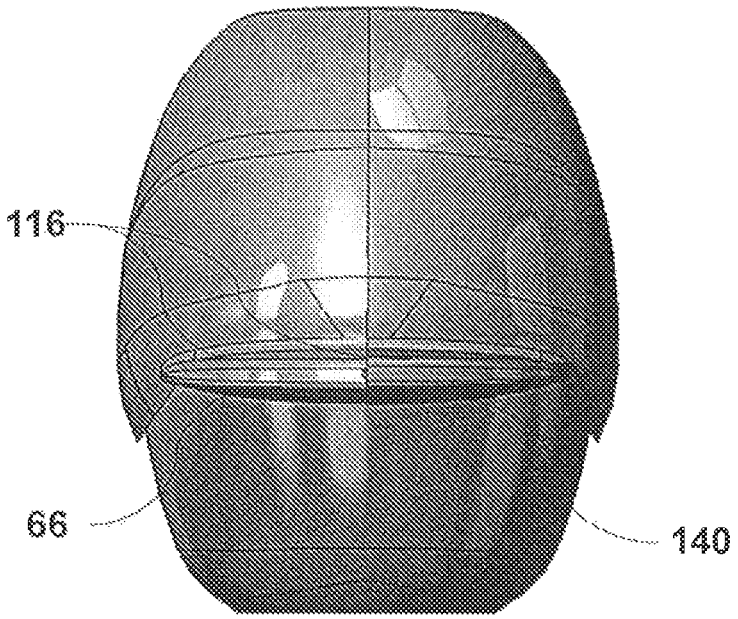
FIG. 6A is a front perspective view showing an embodiment of the applicator device in the closed position.
Figure 6B:
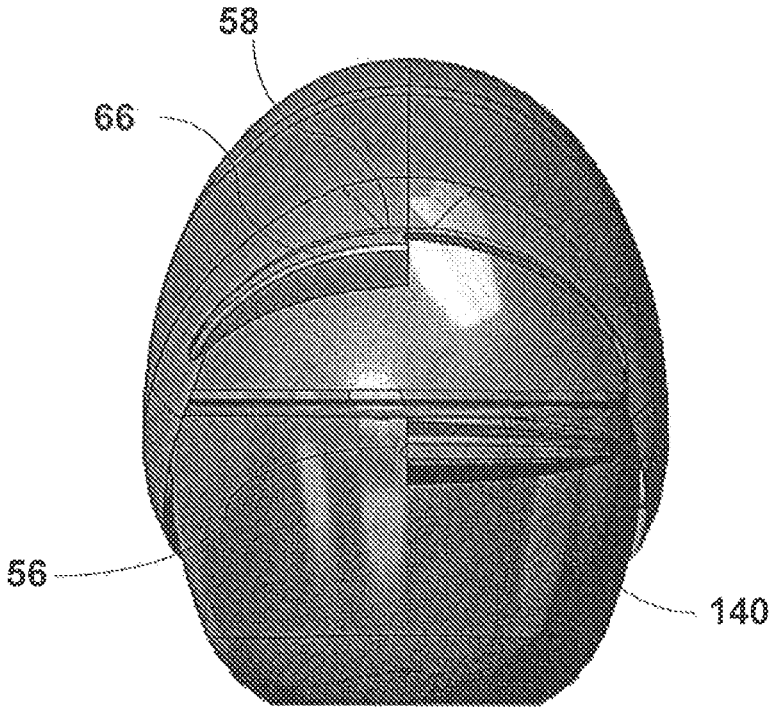
FIG. 6B is a front perspective view showing an embodiment of the applicator device in a partially open position.

A lever 16 may be formed on the front of the first housing portion 20. The lever 16 may be an integrally formed part of the first housing portion (i.e. a single mold), or may be a separate part that is mounted to the first housing portion 20. The lever 16 may be used to help open or close the applicator device when rotating the second housing portion between the open and closed positions. In an alternative embodiment, the lever 16 may be replaced by a clasp 116 (see FIGS. 6A and 6B) A first portion 140 of the clasp 116 is formed on the front of the first housing portion 20, and a second portion 166 of the clasp 116 is formed on the front of the second housing portion. The first portion 140 of the clasp 116 may have a bump 156 or recess 158 that slides or fits into a recess 158 or bump 156 formed in a second portion 166 of the clasp 116.

The bottom housing portion 20 may also include a snap groove 44 that circumscribes the first housing portion 20 at or near the uppermost part of the first housing portion 20. A snap bead 68 formed on the second housing portion 60 fits within the snap groove 44 of the first housing portion 20. Together with the snap bead 68, the snap groove 44 provides some seal integrity when the applicator device 10 is closed to protect the product in a more air tight environment. The snap groove 44 also helps to ensure that the applicator device 10 stays closed when in the closed position.

In an alternative embodiment, the snap groove 44 may be provided on the second housing portion 60 rather than the bottom housing portion 20. In turn, the snap bead 68 is provided on the bottom housing portion 20 rather than the second housing portion 60 (See FIG. 5). In this embodiment, the snap groove 44 circumscribes the inner space of the second housing portion at or near the lowermost part of the second housing portion 60. The snap bead 68 is then formed at or near the uppermost part of the first housing portion 20. Similar to the previous embodiment, the snap bead 68 fits within the snap groove 44 to help ensure that the applicator device 10 stays closed and to provide some seal integrity when the applicator device 10 is closed to protect the product in a more air tight environment.

Referring again to FIG. 2, the first housing portion 20 may further comprise an open position snap bead detent 42. In the embodiment shown in FIG. 2, the detent 42 is a groove formed in the front of the first housing portion 20. The snap bead 68 in the second housing portion 60 fits within detent 42 when the applicator device 10 is in the open position, so that the applicator device 10 remains in the open position until a user asserts sufficient force. In an alternative embodiment, the detent 42 may be a protrusion that fits within the snap groove 44, when the second housing portion 60 includes a snap groove 44 instead of the snap bead 68.

Figure 4A:
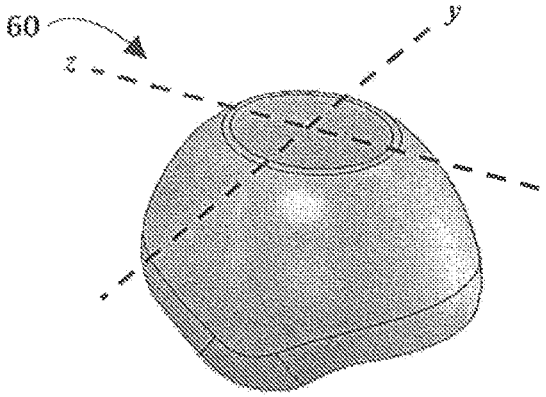
Figure 4B:
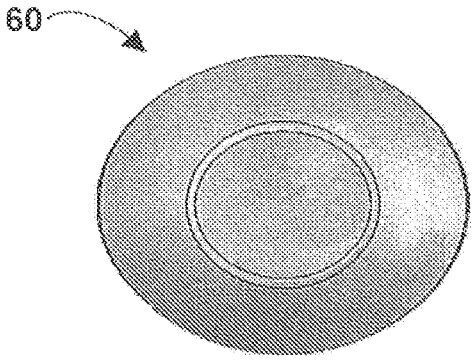
Figure 4C:
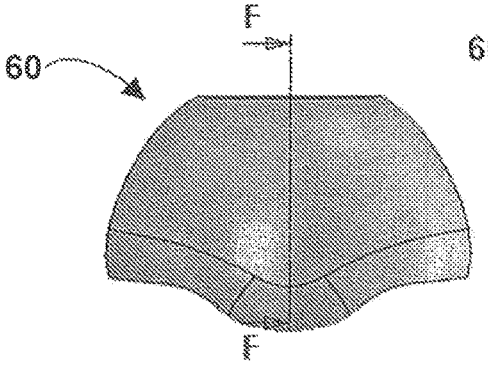
Figure 4D:
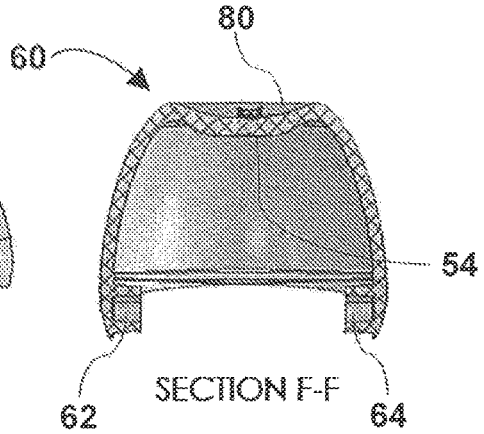
Figure 4E:
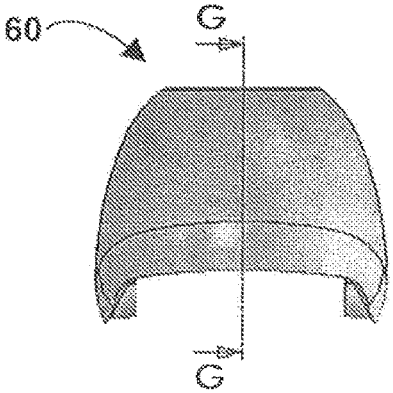
Figure 4F:
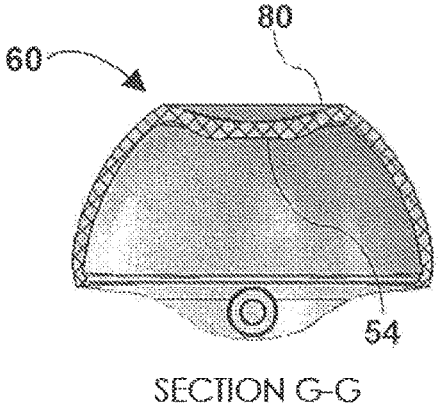

Turning now to FIGS. 4A to 4F, which show the second housing portion 60 of an applicator device 10 according to an embodiment of the present invention. FIGS. 4A and 4B are a perspective view and a top view, respectively. FIG. 4C is a side perspective view. FIG. 4D is a cross-sectional view taken along line F-F in FIG. 4C. FIG. 4E is a back perspective view. FIG. 4F is a cross-sectional view taken along line G-G of FIG. 4E.

In the embodiment shown in FIGS. 4A-4F, the outermost surface of the second housing portion 60 has a substantially semi-ellipsoidal shape, and the outline of the second housing portion 60 is an oval when viewed from above. The top 80 of the second housing portion 60 is cut-off or flattened. The top 80 may have an arcuate concave shape that projects inward. The arcuate concave shape of the top 80 allows a user to better grip the applicator device 10, and may also be used to open the applicator device 10 by, for example, placing a finger or another part of the hand on the arcuate concave surface of the top 60 of the second housing portion 60.

In an embodiment, the underside of the second housing portion, (i.e., the uppermost portion of the inside surface of the second housing portion 60) may have a guide 54, which follows the contour of the product 90 (see FIGS. 1A, 4D and 4F). The guide 54 prevents the product 90 from falling out during, for example, shipment.

The substantially semi-ellipsoidal shape of the second housing portion 60 advantageously allows a person to grip and open the applicator device 10 in a convenient manner. However, it should be understood that the second housing portion 60 is not limited to a semi-ellipsoidal shape and may take another shape, such as semi-spherical.

The second housing portion 60 is manufactured as a shell with sufficient space to house the product 90 when the applicator device 10 is in the closed position, and to house part or all of the first housing portion 20 when the applicator device 10 is in the open position. The second housing portion 60 may, for example, be formed by an injection molding process. However, it should be understood that other processes known in the art may also be used to form the second housing portion 60. The second housing portion 60 may, for example, be formed of polypropylene. However, the second housing is not limited to this material and other plastics, thermoplastics or another suitable material may be used in its place.

The second housing portion 60 includes a first male post 62 and a second male post 64. The first male post 62 and the second male post 64 engage the first female socket 36 and the second female socket 38, respectively, to form the first pivot joint 12 and the second pivot joint 14. The first and second male posts 62 and 64 may have, for example, a circular shape. In such a case, the first and second female sockets 36 and 38 have complementary circular shapes, with the first and second female sockets 36 and 38 having a slightly larger diameter than that of the first and second male posts 62 and 64, so that the first and second male posts 62 and 64 can fit within the first and second female sockets 36 and 38.

The first and second male posts 62 and 64 project outward from an inner surface of the second housing portion 60 and are positioned to allow the second housing portion 60 to rotate about the first housing portion 20. In the embodiment shown in FIGS. 4A-4F, the first and second male posts 62 and 64 are formed on diametrically opposing portions of the second housing portion 60 near the bottom of the second housing portion 60. Further, the first and second male posts 62 and 64 are formed along the short axis y (see FIG. 4A). The first and second male posts 62 and 64 may be integrally formed parts of the second housing portion 60, or may be separate parts mounted to the second housing portion 60.

In an embodiment, the first and second male posts 62 and 64 may also have hollow interiors as can be seen in FIGS. 4D and 4F. The hollow interiors are advantageous over solid interiors, as they are easier/faster to mold, and sink marks on the exterior of the second housing portion 60 are less visible.

The first and second male posts 62 and 64 may also include a plurality of ribs. For example, each of the first and second male posts 62 and 64 may include four ribs. The ribs are formed on the outer surface of the male posts 62 and 64 (i.e., the surface of the male posts 62 and 64 facing the female socket 36 and 38 when the male posts 62 and 64 are inserted into the female sockets 36 and 38), so that the ribs add a small amount of drag as the second housing portion 60 rotates about the first housing portion 20.

The second housing portion 60 may also include a snap bead 68 formed on the inner surface of second housing portion 60. The snap bead 68 circumscribes the inner space of the second housing portion 60 and matches the shape of the snap groove 44. As noted above, the combination of the snap bead 68 and the snap groove 44 provides some seal integrity when the applicator device 10 is closed to protect the product in a more air tight environment, and helps to ensure that the applicator device 10 stays closed when in the closed position.

In the embodiment shown in FIGS. 1-4, the neck 92 of the product 90 is inserted into the opening 22 of the first housing portion 20, and the fins 24 project into the neck 92. In one aspect of the invention, the product 90 is manufacturing using a molding process. In the molding process, a liquefied product is poured into a mold and is then cooled so that the product solidifies. Preferably, the product 90 is molded to the correct shape and inserted into the opening 22 of the first housing portion 20. However, the product may alternatively be cut into its desired shape after it is molded. It should be understood that the manner of manufacturing the product 90 is not limited to this process, and those of ordinary skill in the art can envision alternative processes for creating the product 90 including, for example, a hot pour process.

In addition to the neck 92, the product 90 includes an application portion 94 that is exposed when the applicator device 10 is in the open position. The application portion 94 may rest over, but not touch, the upper surface of the cover 70. The outermost surface of the application portion 94 of the product may have an arcuate shape. In the embodiment shown in FIGS. 1A-1D, the application portion 94 has a semi-ellipsoidal shape. However, the application portion 94 may take other shapes, such as semi-spherical shape.

In an embodiment, the application portion 94 of the product 90 is sized and shaped such that a user can apply the product 90 to the upper lip and lower lip simultaneously. In turn, the first and second housing members 20 and 60 are manufactured to have a size that is sufficient to accommodate a product 90 capable of being applied to both the upper and lower lips simultaneously.

The second housing portion 60 is connected to the first housing portion 20 by way of the first and second pivot joints 12 and 14. The first male post 62 of the second housing portion 60 is inserted into the first female socket 36 of the first housing portion 20 to form the first pivot joint 12. Similarly, the second male post 64 of the second housing portion 60 is inserted into the second female socket 38 of the first housing portion 20 to form the second pivot joint 14. The first and second pivot joints 12, 14 provide the means by which the second housing portion 60 rotates about the first housing portion 20 between the open and closed positions.

The lever 16 helps a user open or close the applicator device 10. Lever 16 may also restrict the rotation of the second housing portion 60 to one direction. For example, rotation of the second housing portion 60 in the direction towards the lever 16 is restricted, since the lever 16 abuts against the edge of the second housing portion 60 when the applicator device is in the closed position (see FIG. 1A).

In the embodiment shown in FIGS. 2A-2F, the lever 16 extends along most if not all of the front of the applicator device 16. However, the lever 16 is not limited to this shape, and may, for example, occupy a smaller space on the front of the applicator device 10.

In the embodiments discussed above, the first and second pivot joints 12 and 14 are formed by a combination of first and second female sockets 36 and 38 formed within the first housing member 20 and first and second male posts 62 and 64 projecting from the second housing portion 60. However, in another embodiment, the pivot joints may be reversed, with male posts projecting from the first housing member 20 and female openings formed within the second housing member 60.

The following is a method of using an applicator device 10 according to an embodiment of the invention. As an initial step, an applicator device 10, such as the embodiment of the applicator device 10 shown in FIGS. 1A-1D, is obtained. The applicator device has a first housing portion 20 onto which a skin-care product 90 is mounted and a second housing portion 60 that rotates about the first housing portion 20.

Upon sufficient force from the user, the second housing portion 60 is moved from the closed position to the open position. This may be accomplished in a number of different ways. In one example, the lever 16 may be used to open the applicator device 10. In another example, a user may place a finger on the concave arcuate shape of the top 80 of the second housing portion 60 and apply force to the top 80 of the second housing portion 60 sufficient to open the applicator device 10. As another example, the semi-ellipsoid shape of the first and second housing portions 20 and 60 allow a user to grip and open the applicator device with one hand. In this example, a user can place a thumb on either the concave arcuate top 80 of the second housing member 60 or on the bottom 50 of the first housing member 20 while wrapping one or more fingers around the other portion. Upon applying sufficient force with the thumb, the user can then open the applicator device 10.

Upon opening the applicator device, the product 90 is applied to a user's lips and/or skin. The product 90 may be sized and shaped to allow a user to apply the product 90 to both of the lips simultaneously. Upon application of the product 90, the applicator device 10 may be returned to its closed position.

While certain embodiments of the applicator device have been described in detail with reference to the accompanying drawings, it should be apparent that modifications and variations thereto are possible, all of which fall within the true spirit and scope of the invention. The invention also includes all of the steps, features, compositions and compounds referred to or indicated in this specification, individually or collectively, and any and all combinations of any two or more of said steps or features.

As such, those skilled in the art will appreciate that the conception, upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other aspects of the invention, along with the various features of novelty that characterize the invention, are pointed out with particularity in the claims annexed to and forming a part of this disclosure. For a better understanding of the invention, its operating advantages and the specific aspects attained by its uses, reference should be had to the accompanying drawings and description matter in which there are illustrated preferred embodiments of the invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. An applicator device for applying a product comprising:

a first housing portion to which said product is adapted to be attached;

a second housing portion rotatably connected to the first attachable housing portion so as to allow the second housing portion to rotate about the first housing portion between a closed position and an open position, wherein:

the second housing portion rotates about the first housing portion such that, in the closed position the product is enclosed within the first housing portion and the second housing portion, and in the open position the product is exposed and the first housing portion is at least partially housed within the second housing portion;

a first pivot joint and a second pivot joint, the second housing portion being rotatably connected to the first housing portion by way of the first pivot joint and the second pivot joint and wherein said first housing portion further comprises an outer wall, an inner wall surrounded by said outer wall, and said inner wall surrounds an opening into which said product is adapted to be inserted and wherein said second housing portion covers a majority of said first housing portion when the device is in the open position, the opening comprising a plurality of inwardly down slanting fins for securing said product.

2. The applicator device of claim 1, wherein:

the first pivot joint comprises a first male post formed on an inner surface of the second housing portion and a first female socket formed within the first housing portion, the first male post and the first female socket being shaped such that the first male post fits within the first female socket; and the second pivot joint comprises a second male post formed on the inner surface of the second housing and a second female socket formed within the first housing portion, the second male post and the second female socket being shaped such that the second male post fits within the first female socket, wherein the first and second male posts are formed on opposing sides of the second housing section and the first and second female sockets are formed within opposing sides of the first housing section, so as to allow the second housing portion to rotate about the first housing portion.

3. The applicator device of claim 1, wherein:

the first pivot joint comprises a first male post formed on an outer surface of the first housing portion and a first female opening extending through the second housing portion, the first male post and the first female opening being shaped such that the first male post fits within the first female opening; and the second pivot joint comprises a second male post formed on an outer surface of the first housing portion and a second female opening extending through the second housing portion, the second male post and the second female opening being shaped such that the second male post fits within the second female opening, wherein the first and second male posts are formed on opposing sides of the first housing section and the first and second female sockets are formed through opposing sides of the second housing section, so as to allow the second housing portion to rotate about the first housing portion.

4. The applicator device of claim 1, wherein the applicator device further comprises a lever formed on a front of an outer surface of the first housing portion for opening or closing the applicator device, wherein the lever is situated on the front of the outer surface so as to restrict rotation of the second housing portion to one direction.

5. The applicator device of claim 1, wherein the applicator device further comprises a clasp for holding the applicator device in the closed position, wherein:

the first housing portion includes a first portion of the clasp formed on an outer surface thereon and the second housing portion includes a second portion of the clasp formed on an outer surface thereof, the first portion of the clasp has a bump or a recess, and the second portion of the clasp has the other of the bump and the recess, and when the second housing portion is in the closed position, the bump is within the recess.

6. The applicator device of claim 1, wherein the first housing portion comprises a snap bead or a snap groove that circumscribes the first housing portion, and the second housing portion comprises the other of the snap bead and the snap groove, wherein the snap bead fits within the snap groove.

7. The applicator device of claim 6, wherein the first housing portion includes a detent formed on an outer surface thereof, wherein the detent engages with either the snap bead or the snap groove of the second housing portion to hold the first housing portion in place when in the open position.

8. The applicator device of claim 1, wherein a top of the second housing portion has an arcuate concave surface that projects inward.

9. The applicator device of claim 1, wherein the second housing member has a substantially semi-ellipsoidal shape to which an upper portion is cut-off to form a top surface.

10. The applicator device of claim 1, wherein the first housing portion has a substantially semi-ellipsoidal shape to which a lower portion is cut off to form a bottom surface.

* * * * *